US005396732A

United States Patent [19]

Andersen

[11] Patent Number: 5,396,732

[45] Date of Patent: Mar. 14, 1995

[54] SAFETY BARRIER

[76] Inventor: Finn Andersen, Niels Bohrsvej 14, DK-8670 Låsby, Denmark

[21] Appl. No.: 38,601

[22] Filed: Mar. 29, 1993

[51] Int. Cl.[6] ..... E06B 3/68

[52] U.S. Cl. ..... 49/55; 49/57; 49/255; 49/380

[58] Field of Search ..... 49/463, 465, 466, 55, 49/57, 380, 255

[56] References Cited

U.S. PATENT DOCUMENTS

| | | | |
|---|---|---|---|
| 1,416,651 | 3/1922 | Lanfair | 49/255 |
| 2,928,146 | 3/1960 | Kuniholm | 49/465 |
| 4,583,715 | 4/1986 | Wright | 49/55 |
| 4,677,791 | 7/1987 | Larson et al. | 49/57 X |
| 4,685,247 | 8/1987 | Alam | 49/57 X |
| 5,117,585 | 6/1992 | Andrisin, III | 49/57 X |

FOREIGN PATENT DOCUMENTS

| | | | |
|---|---|---|---|
| 2193992 | 2/1988 | United Kingdom | 49/55 |

*Primary Examiner*—Philip C. Kannan
*Attorney, Agent, or Firm*—Antonelli, Terry, Stout & Kraus

[57] ABSTRACT

A safety barrier such as, for example, children or pets, is adapted to be removable secured between two opposed supports, with the barrier including a frame structure and an openable gate. The frame structure includes a rigid lower horizontally extending beam and, at one side thereof, a vertically extending pillar. The gate is hinged to one side of the pillar and, on the other side, to a grid. The frame structure is secured between supports by expanding securing means, with the gate having a locking device expandable against one of the supports.

9 Claims, 3 Drawing Sheets

SAFETY BARRIER

FIELD OF THE INVENTION

The present invention relates to a safety barrier and, more particularly, to a safety barrier adapted to be removably secured between two opposed supports and including a frame structure and an openable gate for limiting movement of, for example, children or pets.

BACKGROUND OF THE INVENTION

Safety barriers of the aforementioned type have been proposed which include an openable gate at a center thereof; however, a disadvantage of the proposed safety barriers resides in the fact that the constructional features are not sufficiently rigid so as to ensure a limiting of the movement of children or pets.

SUMMARY OF THE INVENTION

The aim underlying the present invention essentially resides in providing a safety barrier with an openable gate which avoids, by simple means, shortcomings and disadvantages encountered in the prior art and to provide a safety barrier which is not only inexpensive to manufacture but is also considerably more rigid in construction thereby ensuring the safety features of the barrier when the safety barrier is installed.

DETAILED DESCRIPTION

Figure 1:
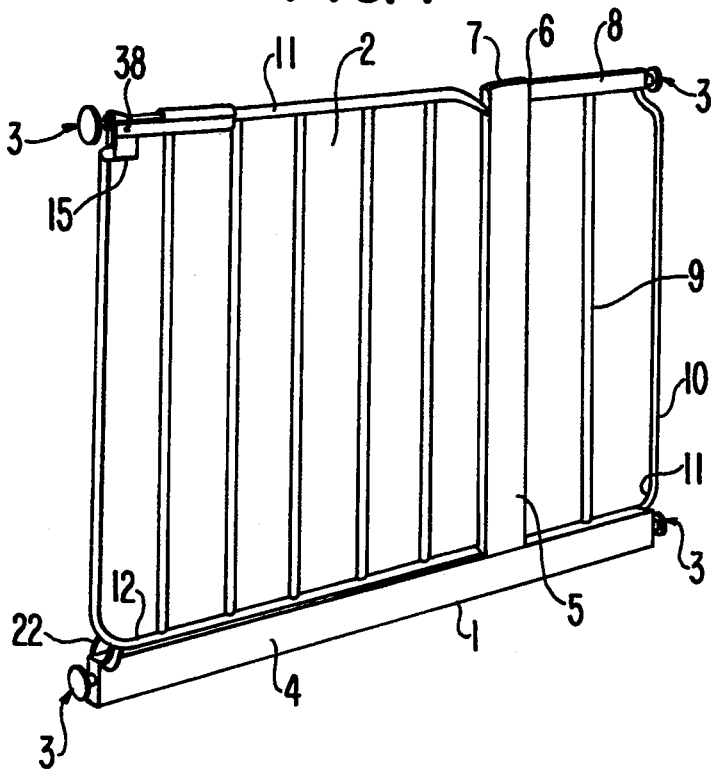
FIG. 1 is a perspective view of an embodiment of a safety barrier constructed in accordance with the present invention with a gate thereof in a closed position.
Figure 2A:
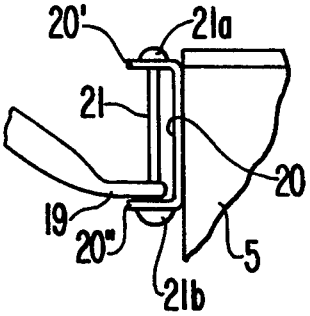
FIG. 2A is an enlarged detail view taken in the area designated 2A in FIG. 2.
Figure 2:
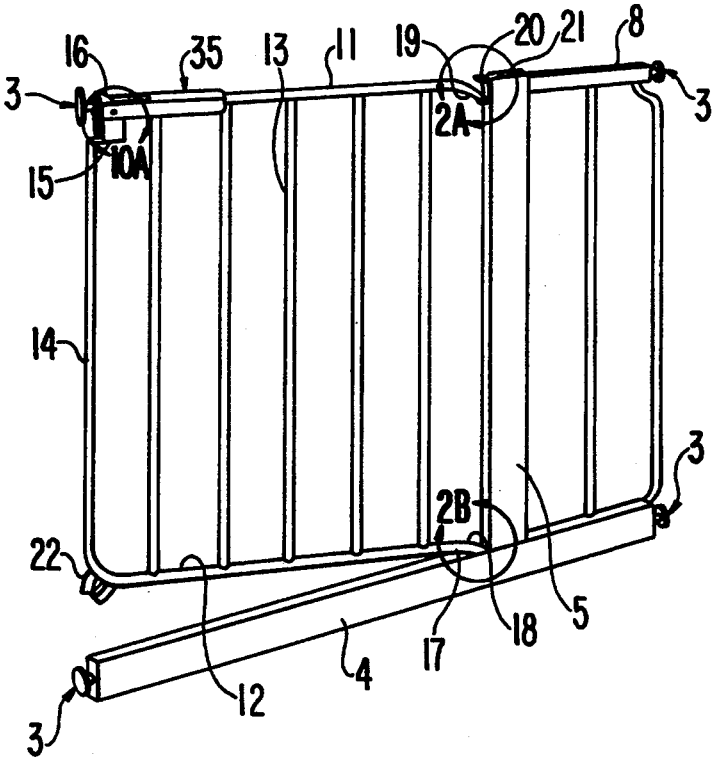
FIG. 2 is a perspective view of the safety barrier of FIG. 1 with the gate in a partially open position.

Referring now to the drawings wherein like reference numerals are used throughout the various views to designate like parts and, more particularly, to FIGS. 1 and 2, according to these figures, a safety barrier, for example, for limiting or confining movement of children and pets, has a substantially rigid frame structure 1, with an openable gate 2 being hingedly attached to the rigid frame structure 1, and with a barrier securing means 3 being provided for securing the safety barrier between opposed supports such as, for example, opposed walls disposed on respective sides of a passageway (not shown).

The rigid frame structure 1 comprises a rigid lower horizontally extending hollow beam 4 having a rectangular cross section, placed edgeways and, at one side, a vertically extending pillar 5 is welded to the horizontally extending hollow beam 4, with the vertically extending pillar 5 and horizontally extending hollow beam 4 having an identical cross section. The top of the vertically extending pillar 5 is closed by a plastic plug 6 having a cross-section adapted to fit snugly into an end of the vertically extending pillar 5 and a flat portion 7 resting on an edge of the vertically extending pillar 5. A short beam 8, having a square cross section and extending horizontally above the lower horizontally extending hollow beam 4 is welded to a top portion of the vertically extending pillar 5. At least one hollow cylindrical rod 9 is disposed between the short beam 8 and the lower horizontally extending hollow beam 4, with the at least one hollow cylindrical rod 9 being disposed substantially in parallel to the vertically extending pillar 5. A further rod 10 is provided at the end of the short beam 8 and the lower horizontally extending hollow beam 4, with the respective ends 11 of the further rod 10 being angled or bent such that the further rod 10 extends beyond outer ends of the short beam 8 and the lower horizontally extending hollow beam 4.

Figure 10A:
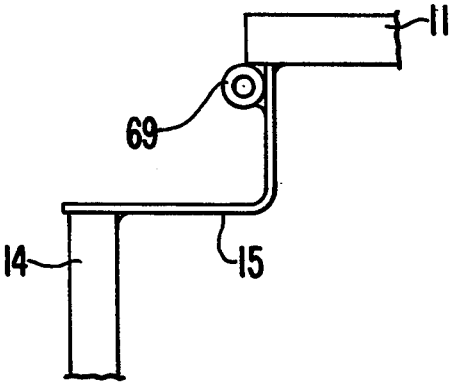
FIG. 10A is an enlarged detail view taken in the area designated 10A in FIG. 2.

The gate 2 is hinged to the other side of the vertically extending pillar 5, with the gate 2 comprising an upper tubular bar 11 and a lower horizontal tubular bar 12 disposed in a parallel spaced relationship. A plurality of spaced vertically extending tubular bars 13 are disposed between the upper and lower horizontal tubular bars 11, 12. The tubular bar 12 is bent upwardly and terminates in an end bar 14 extending in parallel to the vertical tubular bars 13. The end 14 of the lower tubular bar and the end of the upper tubular bar 11 are connected with a flat angularly shaped steel member 15 of flat steel, with one end of the flat angularly shaped steel member 15 being placed on top or above an end of the end bar 14 of the lower horizontal tubular bar 12 and welded thereto, and with the other end of the flat angularly shaped steel member 15 being welded to an underside of the upper horizontal tubular bar 11 as shown most clearly in FIG. 10A. A locking device 16 is disposed in a corner of the gate 2 in an area of the angular member 15.

Figure 2B:
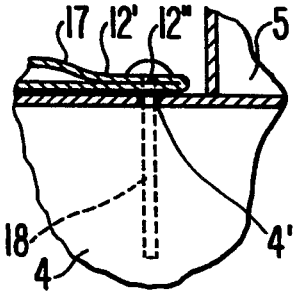
FIG. 2B is an enlarged detail view taken in an area designated 2B in FIG. 2.

The other end of the gate 2 is hingedly attached to the vertically extending pillar 5. The end of the lower horizontal tubular bar 12 terminates, as shown most clearly in FIG. 2B, in a flat section 12' having a hole 12'' therein for securely accommodating a pin 18 extending downwardly in a hole 4' provided in an upper side of the lower horizontally extending hollow beam 4. The end of the upper horizontally extending tubular bar 11 is, as shown in FIG. 2A, curved downwardly and terminates in a flat horizontal member or portion 19 provided with a through hole. The flat horizontal member or portion 19 is located between legs 20', 20'' of a U-shaped hinge member 20, with the U-shaped hinge member 20 being welded to the upper end of the vertically extending pillar 5, and with the legs 20', 20'' of the U-shaped hinge member 20 extending in a horizontal direction towards the gate 2. A pin 21 extending through a hole in each of the legs 20', 20" with the pin 21 also extending through a hole provided in the flat member or portion 19 of the upper horizontal tubular bar 11 of the gate 1. The pin 21 is secured in its position by heads 21*a*, 21*b* provided at the respective ends of the pin 21, with the heads 21*a*, 21*b* resting against outer sides or surfaces of the legs 20', 20" of the U-shaped hinge member 20.

In a closed position of the gate, a lower free end of the gate 2 is locked to a horizontal beam 4 by the U-shaped locking member 22 is welded to the lower horizontally extending tubular bar 12, with the locking member 22 being adapted to grasp, with outer ends thereof, on each side of the lower horizontally extending beam 4. Furthermore, the locking member 22 is placed in a forward inclined direction and positioned so as to prevent children from putting fingers or toes in the triangular space otherwise present between the curved section of the gate 2 and the lower horizontally extending beam 4.

Figure 9:
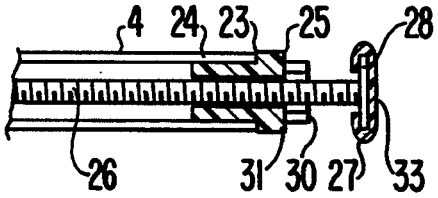
FIG. 9 is a longitudinal cross-sectional view of a securing means at corners of the frame structure of the safety barrier of the present invention.

The lower horizontally extending beam 4 has identical securing means 3 provided at either end. The respective ends of the lower horizontally extending beam 4 may, as shown in FIG. 9, be closed with a plastic plug 23 having a portion 24 adapted to be fitted inside the lower horizontally extending beam 4 and a flat outer portion 25 resting against an edge of the lower horizontally extending beam. The plug member 23, is provided with a through hole for accommodating a threaded rod 26, with one end of the threaded rod 26 having a foot member 27 including a circular steel plate 28 having a molded-on rubber covering 33. A lock nut 30 and washer 31 are provided on the threaded rod 26, with the lock nut 30 and washer 31 acting against an outer face of the plastic plug member 23. The upper hollow square beam 8 has an identical securing means 3 (FIG. 1) with the plastic plug end member (not shown) having a corresponding square cross-sectional configuration.

The length of the safety barrier is adjustable and is adapted to a width of a passageway where it is to be installed by adjusting the projecting length of the securing means 3, such that it may easily be fitted into the passageway, with the lower horizontally extending beam resting on the floor or other support surface. The safety barrier is then secured in the passageway by expanding the securing means 3 against the side walls (not shown) of the passageway by adjusting the lock nuts 30 relative to the threaded rod 26 until the three foot members 27 firmly abut the sidewalls of the passageway. The rubber covering 33 on the foot member 27 have several advantages, namely, the foot members do not leave impression marks on the walls or, at least only minor unnoticeable marks, and the rubber covering 33 prevents the safety barrier from sliding on the side walls of the passageway when the safety barrier is exposed to forces in the transverse direction which is most common when, for example, a child or pet bumps or stumbles into the safety barrier.

Figure 4:
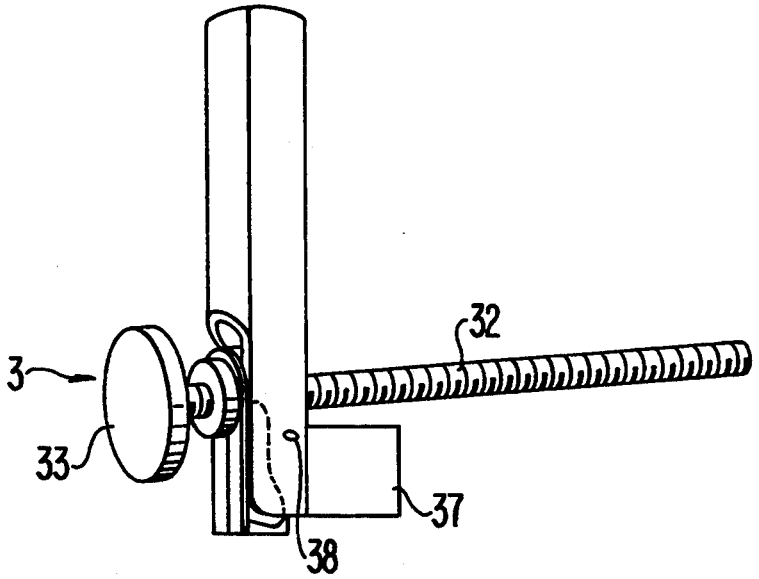
FIG. 4 is an enlarged perspective view of the locking device of FIG. 3 in an open position.
Figure 5:
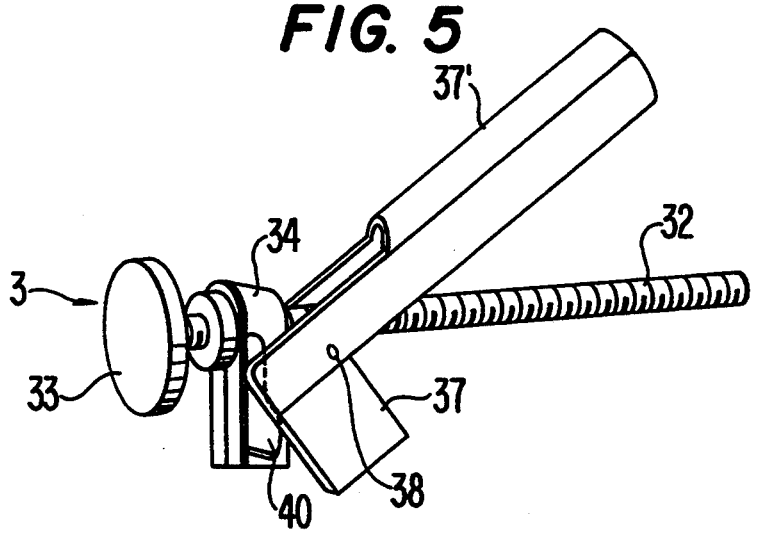
FIG. 5 is a perspective view of the locking device of FIGS. 3 and 4 in an intermediate position between the locked and open position.
Figure 6:
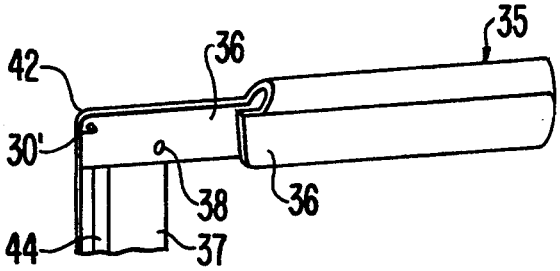
FIG. 6 is a plan view of a handle of a locking device with a side part cut away.
Figure 7:
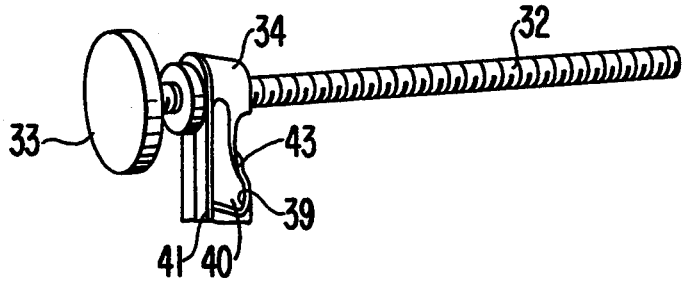
FIG. 7 is a view of the securing means of the locking device of the present invention.
Figure 8:
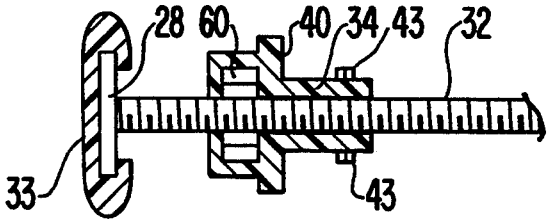
FIG. 8 is a longitudinal cross-sectional view of a front of the securing means of FIG. 7.

As shown in FIGS. 7 and 8, the gate 2 includes a locking device 16 (FIG. 2) including a threaded rod 32 having a steel plate 28 with a molded-on rubber cover 33 as in the three corners of the safety barrier described hereinabove in connection with FIGS. 1 and 2. The end of the threaded rod 32 extends into an open end of the upper horizontally extending tubular bar 11 of the gate 2. The locking device 16 further comprises a plastic member 34 (FIG. 8) having an embedded nut 60 and an axially extending through hole for accommodating the threaded rod 32. The threaded rod 32 is maintained in a selected position by the locking nut 60 encapsulated in the plastic member 34. The plastic member 34 is located in the corner of the gate 2 formed by the flat angularly shaped steel member 15 (FIGS. 1 and 4) and rests on a horizontal portion of the upper horizontally extending member 11. Furthermore, the locking device 16 comprises a handle 35 having two parallel side walls 36 at either side of the upper horizontally extending bar 11 and is connected with an upper curved portion 37' overlaying the horizontally extending bar 11 when the handle 35 is in a locked position.

Figure 3:
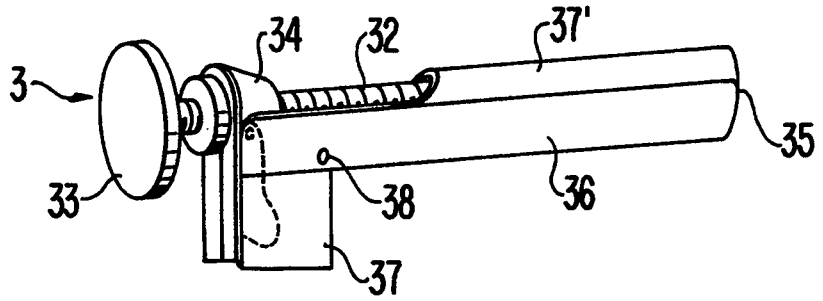
FIG. 3 is an enlarged perspective view of a locking device of the safety barrier of the present invention in a locked position.

The upper curved portion 37' extends, from a rear end of the handle 35, only over a portion of a length of the handle 35, thereby providing a free area in a front area between the side walls 36. The handle 35 is rotatable about an axle 38. The axle extends through through holes 38' in the side walls 36 and a bearing 69 (FIG. 10A) welded to a front end of the vertical leg of the angularly shaped flat steel member 15 and an end of the upper tubular member 11. The axle 38 is fixed by enlarged heads (not shown) provided on respective ends of the axle 38, with the enlarged heads resting on an outer side or surface of the side walls 36. Protrusions 30' are provided at the front end of the internal sides of the side walls 36, with the protrusions 30' having a circular cross section and being engageable a cam surface 39 (FIG. 7) and a recess 40 on either side of the plastic member 34. At the front end of the handle 35, integral with the side walls, there are provided two downwardly extending portions 37 (FIG. 3). The side walls 36 are provided with a curved portion 42 at an upper corner thereof, with the curved portion 42 being adapted to act against the transverse side wall 41 (FIG. 7) for pushing the plastic member 34 forwardly and thereby pressing the steel plate 28 with the rubber cover 33 against the wall of the passageway. A small protrusion 43 is provided on an edge of the recess 40, with the small protrusion 43 being cooperable and acting together with or being cooperable with the recess 44 provided in the extensions 37 of the side walls 36 so that, as shown in FIG. 3, the protrusion 43 rests in the recess 44 at the top thereof; however, when lifting the handle 35, the plastic member is retracted since the protrusion 38, acting on the cam surface in the recess or groove 40 pulls the plastic member 34 in a rearward direction.

The gate 2 is opened by pulling the handle upward direction thereby releasing the locking device 16 and, more particularly, the rubber covered steel plates 28 from engagement with a wall of the passageway. Furthermore, it is necessary to lift the gate in an upward direction so that the U-shaped locking member 22 disengaged from the lower horizontally extending beam 4. To close the gate 2, it is necessary to lift the gate 2 upwardly and then lower the same so as to enable the U-shaped locking member 22 to be brought into engagement with the lower horizontally extending hollow beam 4. The handle 35 then pushed downwardly until the handle 35 rests flush on the upper tubular bar 11.

Figure 11:
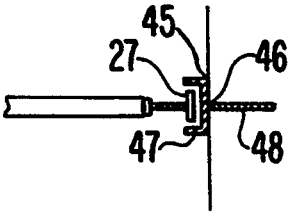
FIG. 11 is a cross-sectional view of a cup for receiving a foot element of the securing means of the safety barrier of the present invention.

As shown in FIG. 11, a cup 45 may be mounted on the side walls of the passageway for receiving the foot members 27 and the steel plates 28 and rubber cover 33 forming the securing means 3. The cup 45 includes a base plate 46, and an annularly arranged surrounding wall 47, with a hole being provided in a center of the base plate 46 for enabling a securing the cup 45 to the wall by a suitable fastener such as, for example, a screw or nail 48.

When mounting the safety barrier, the rubber covered foot elements are placed in the cups 45 and are tightened as described hereinabove. The side walls of the passageway, especially, for example, a doorway, may yield and thereby the rubber covered foot members may loose a firm engagement after a period of time; however, the foot members will be retained in the cups 45 since the foot members cannot move in a sideward or lateral direction.

While I have shown and described only one embodiment in accordance with the present invention, it is understood that the same is not limited thereto but is susceptible to numerous changes and modifications as known to one of ordinary skill in the art, and I therefore do not wish to be limited to the details shown and described herein, but intend to cover all such modifications as are encompassed by the scope of the appended claims.

I claim:

1. A barrier comprising:

a rigid frame having a lower horizontally extending rigid beam and a vertical pillar secured to the rigid beam;

an openable gate hingedly secured to the rigid frame, said gate being hingedly secured to a first side of the vertical pillar;

vertical bars disposed on a side of said vertical pillar opposite said first side and extending between the lower horizontally extending rigid beam and a beam rigidly secured at a top end of the vertical pillar;

securing means disposed at respective opposite ends of said lower horizontally extending beam and at one end of the beam rigidly secured at the top of the vertical pillar for securing the barrier between opposed supports, said securing means is expandable to secure the barrier positioned between the opposed supports, and wherein the gate includes an expandable locking device adapted to be brought into abutment with one of the opposed supports when the gate is in a locked position.

2. A barrier according to claim 1, wherein the securing means includes a foot element disposed at an end of a threaded rod accommodated in the respective ends of the lower horizontally extending rigid beam and at said one end of the beam rigidly secured at the top of the vertical pillar, and wherein a locking nut is provided on each of the threaded rods.

3. A barrier according to claim 1, wherein the securing means includes a foot element at an end of a threaded rod accommodated in a hole in a plug element fitted into respective ends of the lower horizontally extending rigid beam, and wherein a lock nut is threadable provided on each threaded rod and is adapted to act on an end surface of the plug.

4. A barrier according to one of claims 2 or 3, wherein each foot element includes a steel plate having a rubber cover molded thereon.

5. A barrier according to claim 1, wherein the gate comprises an upper and lower horizontal bar, an end of the lower horizontal bar of the gate is hinged to an upper side of the lower horizontally extending beam by a pin movable in a longitudinal direction of the pin, and wherein an end of the upper bar is hingedly secured to the vertical pillar by a U-shaped member rigidly secured thereto, and the end of the upper bar is located between legs of the U-shaped member and maintained in position by a pin extending through legs of the U-shaped member and the end of the upper bar.

6. A barrier according to claim 1, wherein an underside of the gate includes a U-shaped locking member engaging an upper side of the lower horizontally extending beam when the gate is in the locked position.

7. A barrier according to claim 1, wherein the gate includes a lower bar, said lower bar of the gate being curved upwardly for forming a vertical bar at a front end of the gate, and wherein an underside of the gate at the curving includes a U-shaped locking member engageable with an upper side of the lower horizontally extending beam when the gate is in the locked position.

8. A barrier according to claim 1, wherein the gate includes an upper horizontal bar and a forward vertically extending bar, and wherein an end of the upper horizontal bar of the gate and an end of the forward vertically extending bar are rigidly mutually secured by an angular member so as to form a corner portion, and wherein the locking device is placed in said corner portion of the gate.

9. A barrier according to claim 1, wherein the locking device comprises a threaded rod, a locking nut mounted on said threaded rod, a foot element mounted on a free end of the threaded rod, a member having an embedded nut for the rod, a handle lever rotatable about an axis extending transversely of the barrier and having protrusions engaging a cam surface on the member, and wherein a foremost part of the handle is arranged to engage a surface on the member, such that the member is pushed forwardly when the handle is pushed downwardly, and the member is retracted when the handle is lifted thereby disengaging the foot element on the free end of the threaded rod.

* * * * *